US012447372B1

(12) United States Patent
Anderson et al.

(10) Patent No.: US 12,447,372 B1
(45) Date of Patent: Oct. 21, 2025

(54) RESISTANCE BAND ADAPTER FOR A BARBELL

(71) Applicants: Karl Anderson, San Diego, CA (US); David Klarzuk, Elk Grove, CA (US)

(72) Inventors: Karl Anderson, San Diego, CA (US); David Klarzuk, Elk Grove, CA (US)

( * ) Notice: Subject to any disclaimer, the term of this patent is extended or adjusted under 35 U.S.C. 154(b) by 0 days.

(21) Appl. No.: 19/187,536

(22) Filed: Apr. 23, 2025

Related U.S. Application Data

(60) Provisional application No. 63/637,750, filed on Apr. 23, 2024.

(51) Int. Cl.
*A63B 21/055* (2006.01)
*A63B 21/04* (2006.01)
*A63B 21/072* (2006.01)

(52) U.S. Cl.
CPC ..... *A63B 21/0557* (2013.01); *A63B 21/0428* (2013.01); *A63B 21/0724* (2013.01)

(58) Field of Classification Search
CPC . A63B 21/072; A63B 21/0724; A63B 21/075; A63B 21/0557
See application file for complete search history.

(56) References Cited

U.S. PATENT DOCUMENTS 5,295,934 A * 3/1994 Collins ..... A63B 21/0728 482/107
6,770,016 B1 * 8/2004 Anderson ..... A63B 21/0724 482/106
7,841,970 B2 * 11/2010 Striar ..... A63B 21/0728 482/99
9,504,869 B2 * 11/2016 Gavigan ..... A63B 21/0728
10,780,333 B2 * 9/2020 Welch ..... A63B 21/0724
2011/0152042 A1 * 6/2011 Anderson ..... A63B 21/0726 482/108
2018/0125746 A1 * 5/2018 Kokakis ..... A63B 21/4037
2019/0118026 A1 * 4/2019 D'Alesio ..... A63B 21/0442
2019/0217147 A1 * 7/2019 Garcia ..... A63B 21/0724
2020/0238126 A1 * 7/2020 Anderson ..... A63B 21/0407
2023/0113068 A1 * 4/2023 Garcia ..... A63B 21/0728 482/106
2024/0316390 A1 * 9/2024 Yazdanshenas .... A63B 21/0724
2025/0065179 A1 * 2/2025 Jones ..... A63B 21/0724

* cited by examiner

*Primary Examiner* — Zachary T Moore

(57) ABSTRACT

A resistant band adapter for a barbell is a device that facilitates the safe and efficient attachment of a resistance band to the desired barbell to improve the efficiency of the exercise being performed. The device includes a cylindrical body, a first flange, a second flange, a first adapter hole, and a second adapter hole. The cylindrical body corresponds to the main structure of the device that supports the attachment of the desired resistant band to the target barbell. The first flange and the second flange limit the lateral movement of the attached resistance band to prevent the resistance band from disengaging the cylindrical body. The first adapter hole enables the cylindrical body to slide along the selected barbell sleeve of the target barbell. The second adapter hole enables the cylindrical body to engage the corresponding sleeve collar of the selected barbell sleeve.

16 Claims, 9 Drawing Sheets

RESISTANCE BAND ADAPTER FOR A BARBELL

The current application claims a priority to the U.S. provisional patent application Ser. No. 63/637,750 filed on Apr. 23, 2024.

FIELD OF THE INVENTION

The present invention generally relates to accessory adapters and exercise equipment. More specifically, the present invention discloses a removable collar adapter that slips over a barbell sleeve to facilitate the safe and secure looping of a resistance band to the barbell's collar.

BACKGROUND OF THE INVENTION

The design of an Olympic barbell is over 100 years old and was designed for lifting weight plates. In general, barbells include an elongated shaft with two cylindrical sleeves at each end of the shaft. The weight plates are designed so that the weight plates can be slid over the barbell sleeves by including a center hole on the weight plate. In addition, two sleeve collars are used to separate the barbell sleeves from the barbell shaft, and some designs allow the barbell sleeves to rotate about the central axis of the barbell shaft. Further, the outer surface of the sleeve collar serves as a stop and locating reference point when loading weight plates on the barbell.

The sleeve collars are positioned in the ideal area for the placement of a resistance band, between the knurled gripping area and the plate loading area of the barbell. However, these sleeve collars are in most cases too narrow and too smooth to securely hold resistant bands, which can pose an injury risk to the user. Thus, there needs to be a safe and efficient alternative to facilitate the attachment of resistance bands to a barbell for exercising.

SUMMARY OF THE INVENTION

The present invention discloses a resistance band adapter for a barbell. The present invention facilitates the attachment of resistance bands to a barbell to increase the overall load on the user while exercising. The present invention includes a cylindrical adapter with a design that matches the design of the barbell's sleeves and collars. This way, the present invention can be slid over the barbell sleeve and engage the corresponding sleeve collar. The present invention can be designed for sleeve collars with circular-shaped cross-sections, hexagonal-shaped cross-sections, or other commercially available sleeve collars with different cross-sectional shapes. Once engaged, the corresponding sleeve collar is covered by the present invention to accommodate the desired resistance band around the sleeve collar. Two units of the present invention should be used to position two resistance bands on both sleeves of the barbell so that the added resistance is evenly distributed along the barbell shaft.

Further, the adapter of the present invention is designed so that once the adapter is engaged to the corresponding sleeve collar, the mounted weights and the attached barbell clamp keep the adapter in place. This way, the adapter of the present invention nor the attached resistance band obstruct the mounting of the desired weight plates to the barbell. Furthermore, the present invention can include different features that facilitate the use and/or storage of the present invention. For example, different units of the present invention can include ornamental designs with different colors, patterns, decorations, etc., that help the user identify the selected unit and/or the unit's recommended use. Additional features and benefits of the present invention are further discussed in the sections below.

DETAILED DESCRIPTION OF THE INVENTION

All illustrations of the drawings are for the purpose of describing selected versions of the present invention and are not intended to limit the scope of the present invention.

Figure 1:
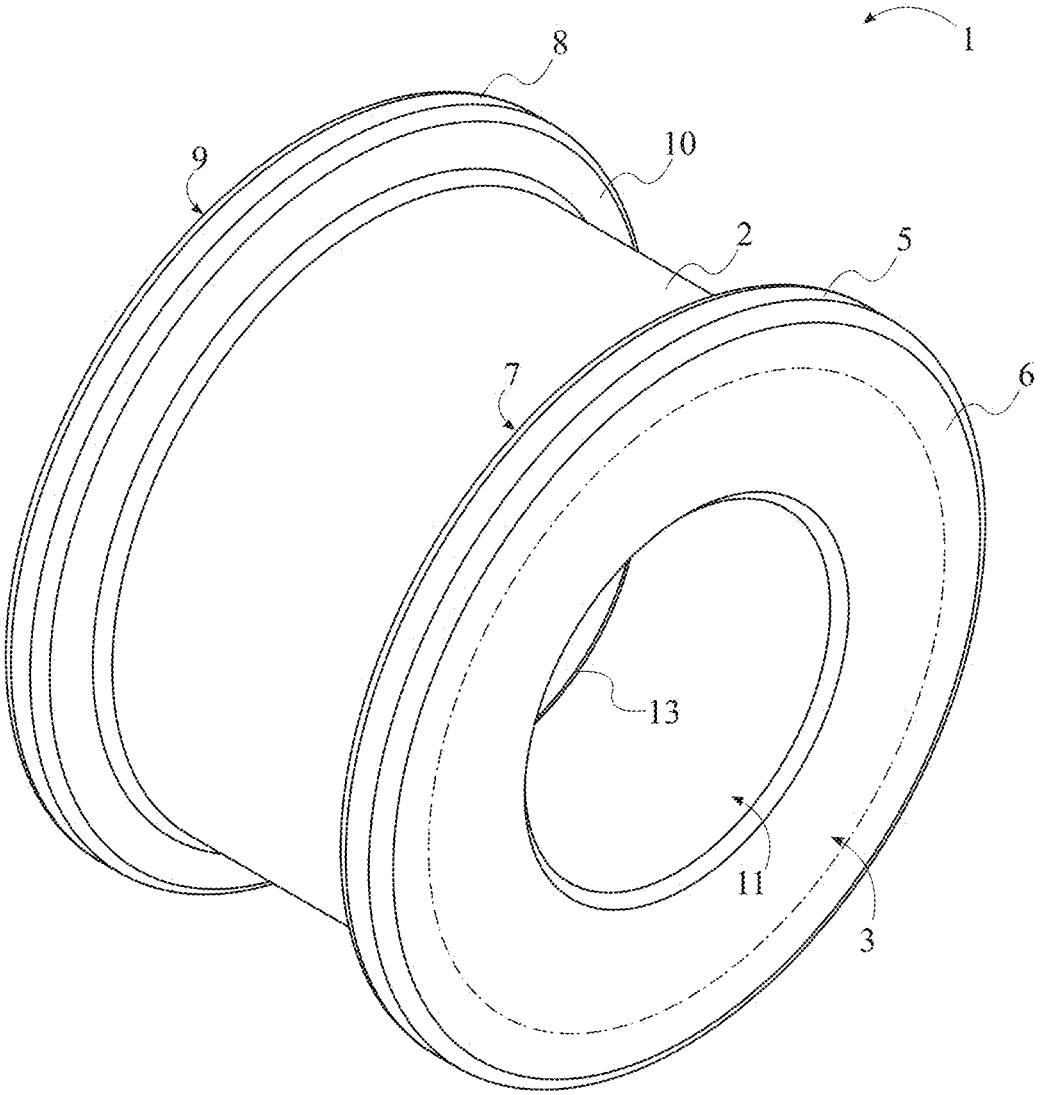
FIG. 1 is a top-front-left perspective view of the present invention.
Figure 2:
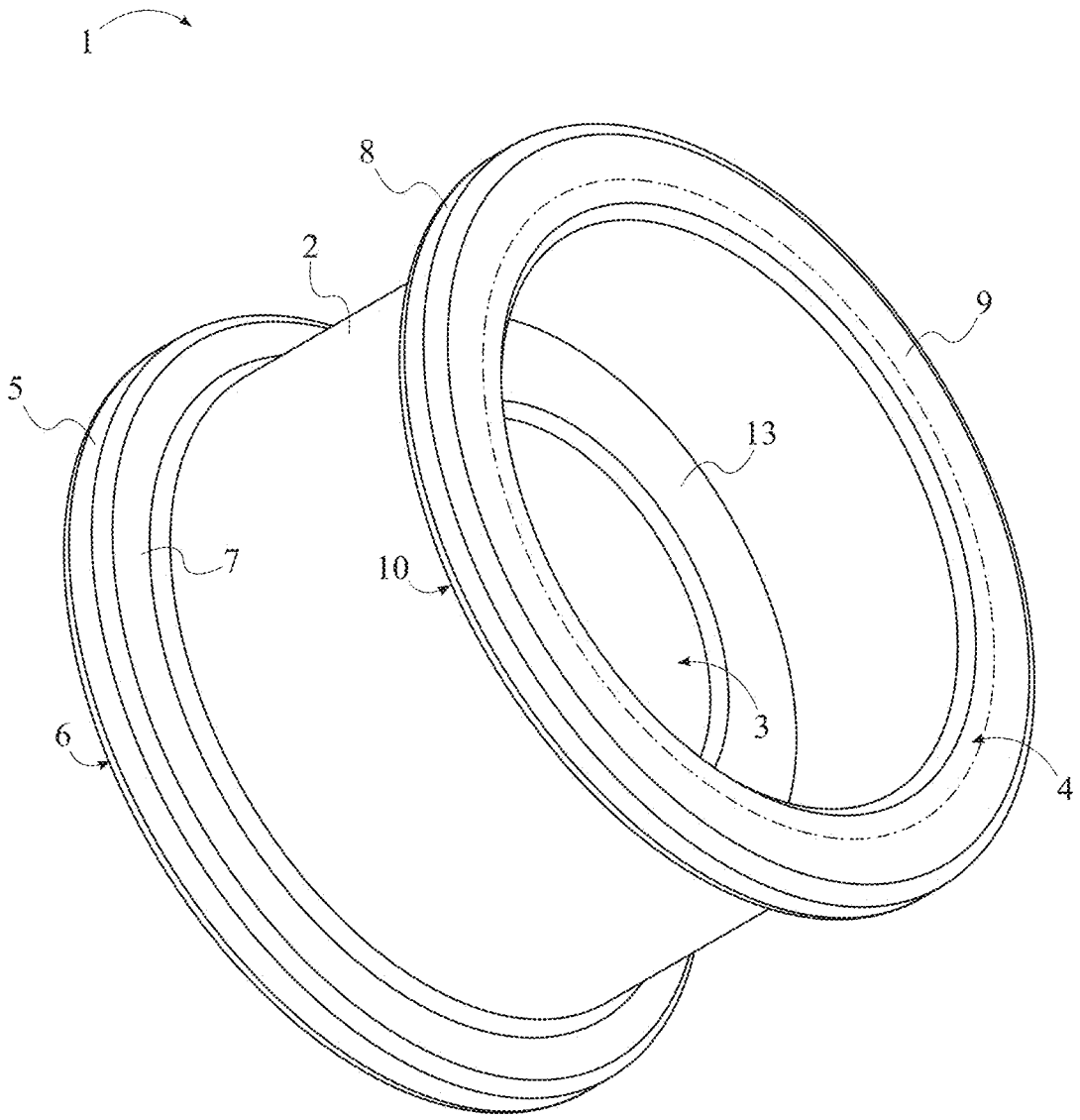
FIG. 2 is a bottom-rear-right perspective view of the present invention thereof.
Figure 3:
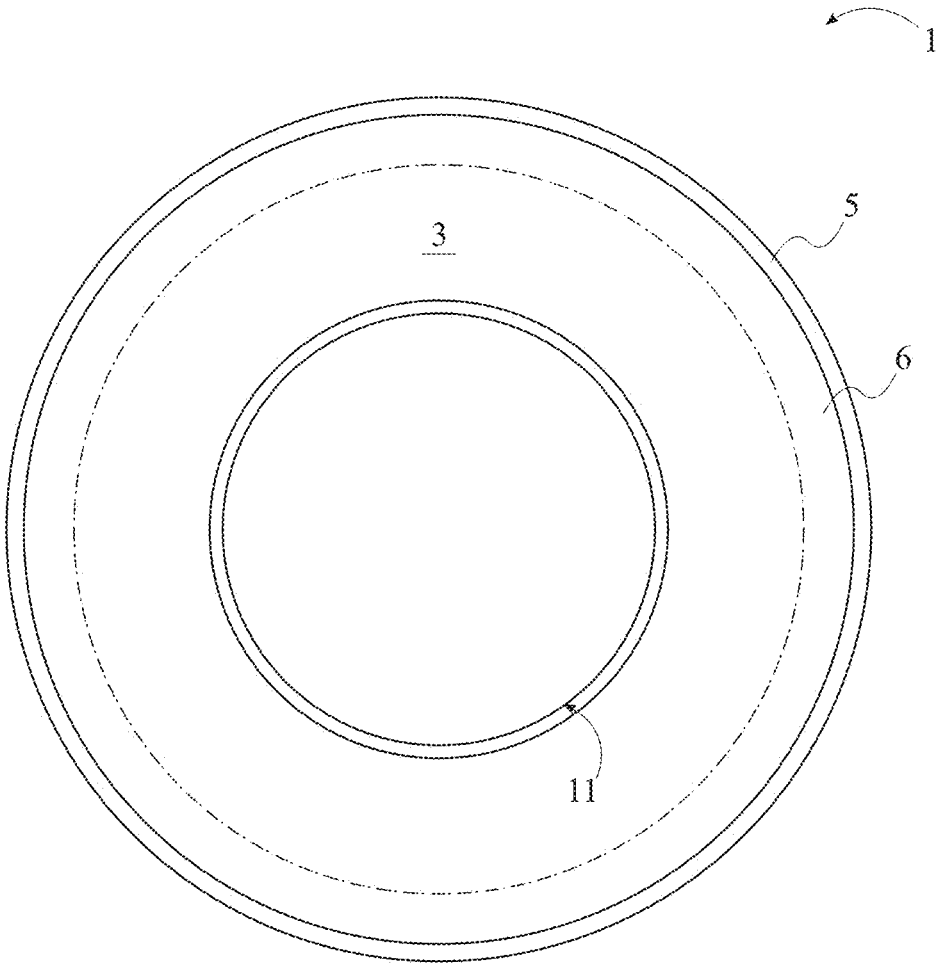
FIG. 3 is a left view of the present invention thereof.
Figure 4:
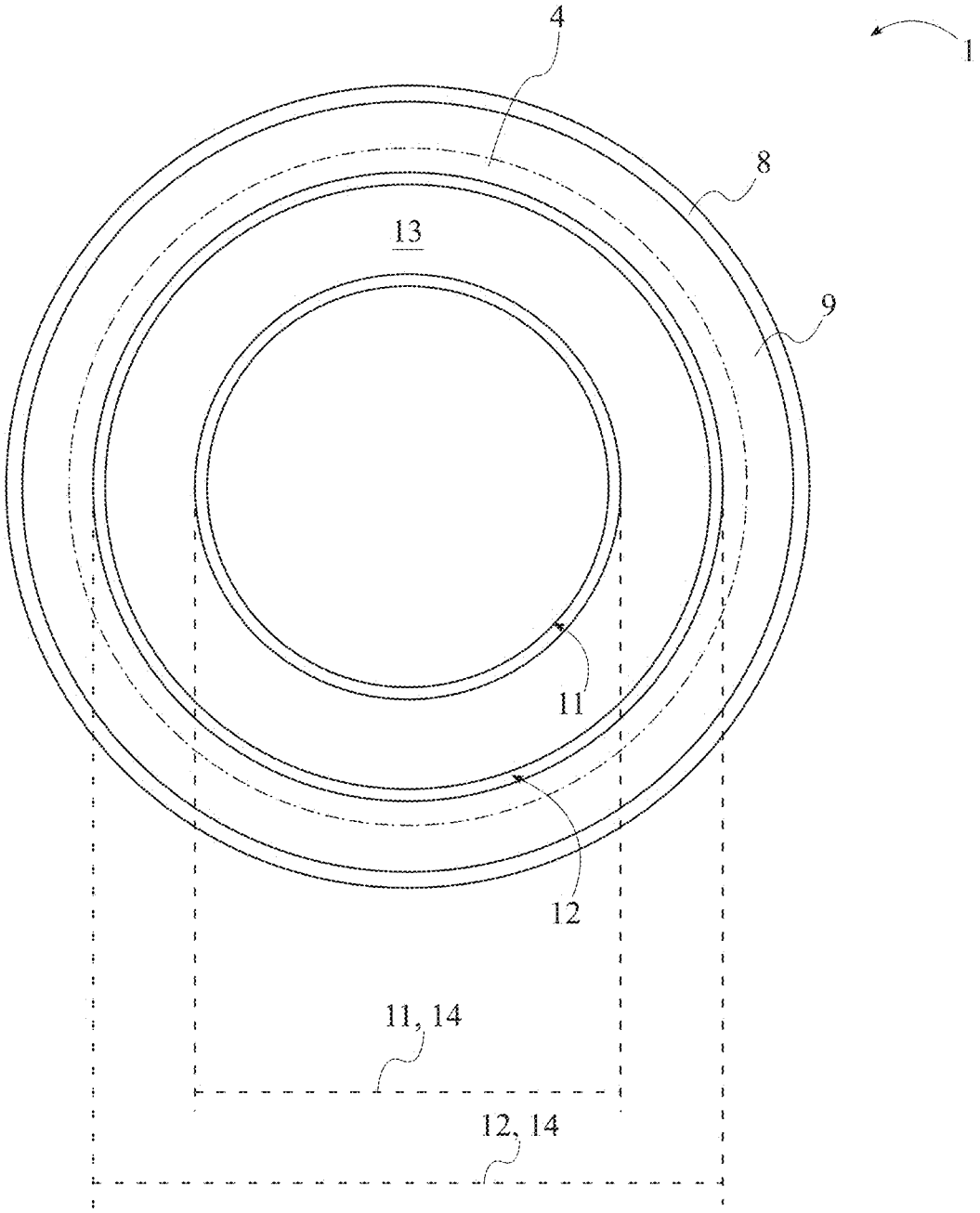
FIG. 4 is a right view of the present invention thereof.
Figure 5:
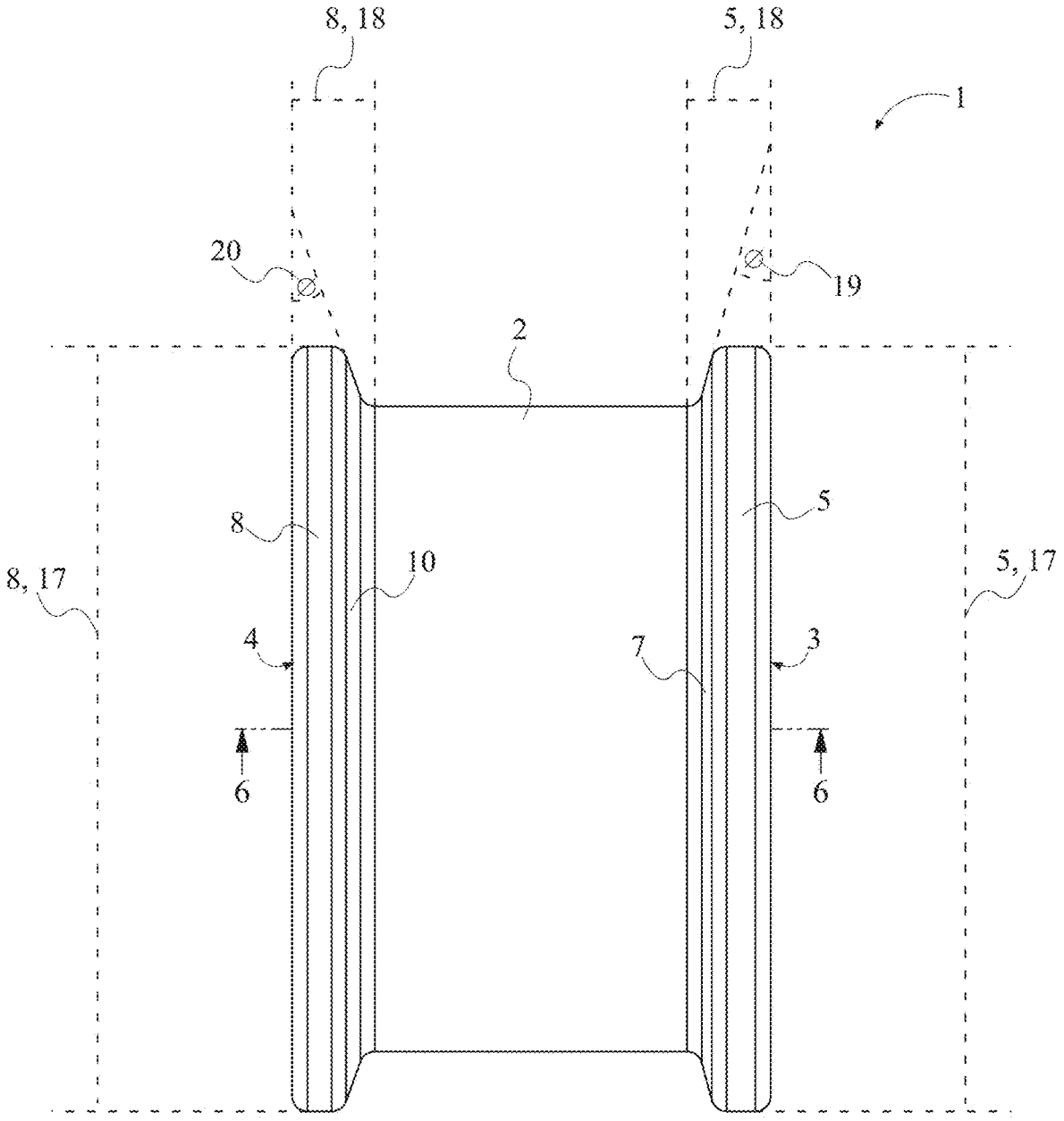
FIG. 5 is a front view of the present invention thereof.
Figure 6:
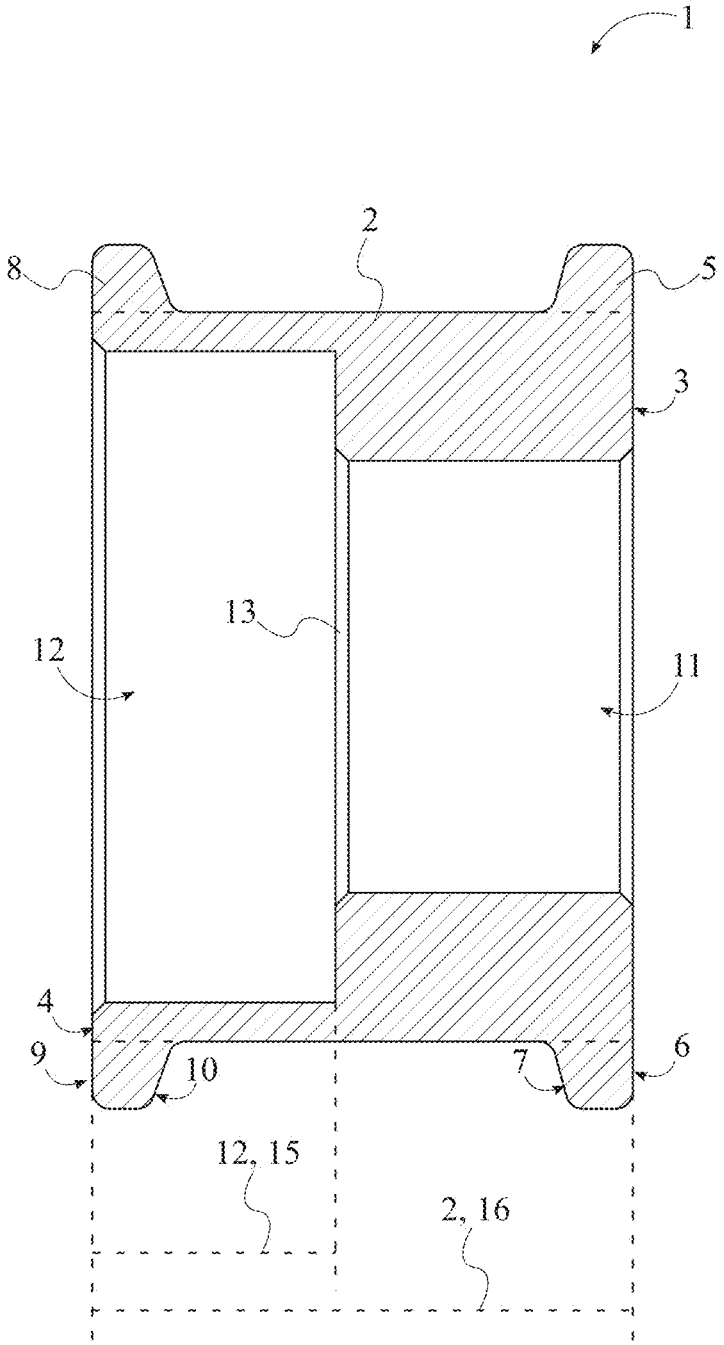
FIG. 6 is a horizontal cross-sectional view of the present invention taken along line 6-6 shown in FIG. 5.

The present invention discloses a resistant band adapter for a barbell that can be utilized to facilitate the safe and efficient attachment of a resistance band to the desired barbell to improve the efficiency of the exercise being performed. As can be seen in FIG. 1 through 6, the present invention comprises a cylindrical body 1, a first flange 5, a second flange 8, a first adapter hole 11, and a second adapter hole 12. The cylindrical body 1 corresponds to the main structure of the present invention that facilitates the attachment of the desired resistance band to the target barbell. The first flange 5 and the second flange 8 limit the lateral movement of the attached resistance band to prevent the resistance band from disengaging the cylindrical body 1. The first adapter hole 11 enables the cylindrical body 1 to slide along the selected barbell sleeve of the target barbell. The second adapter hole 12 enables the cylindrical body 1 to engage the corresponding sleeve collar of the selected barbell sleeve.

Figure 7:
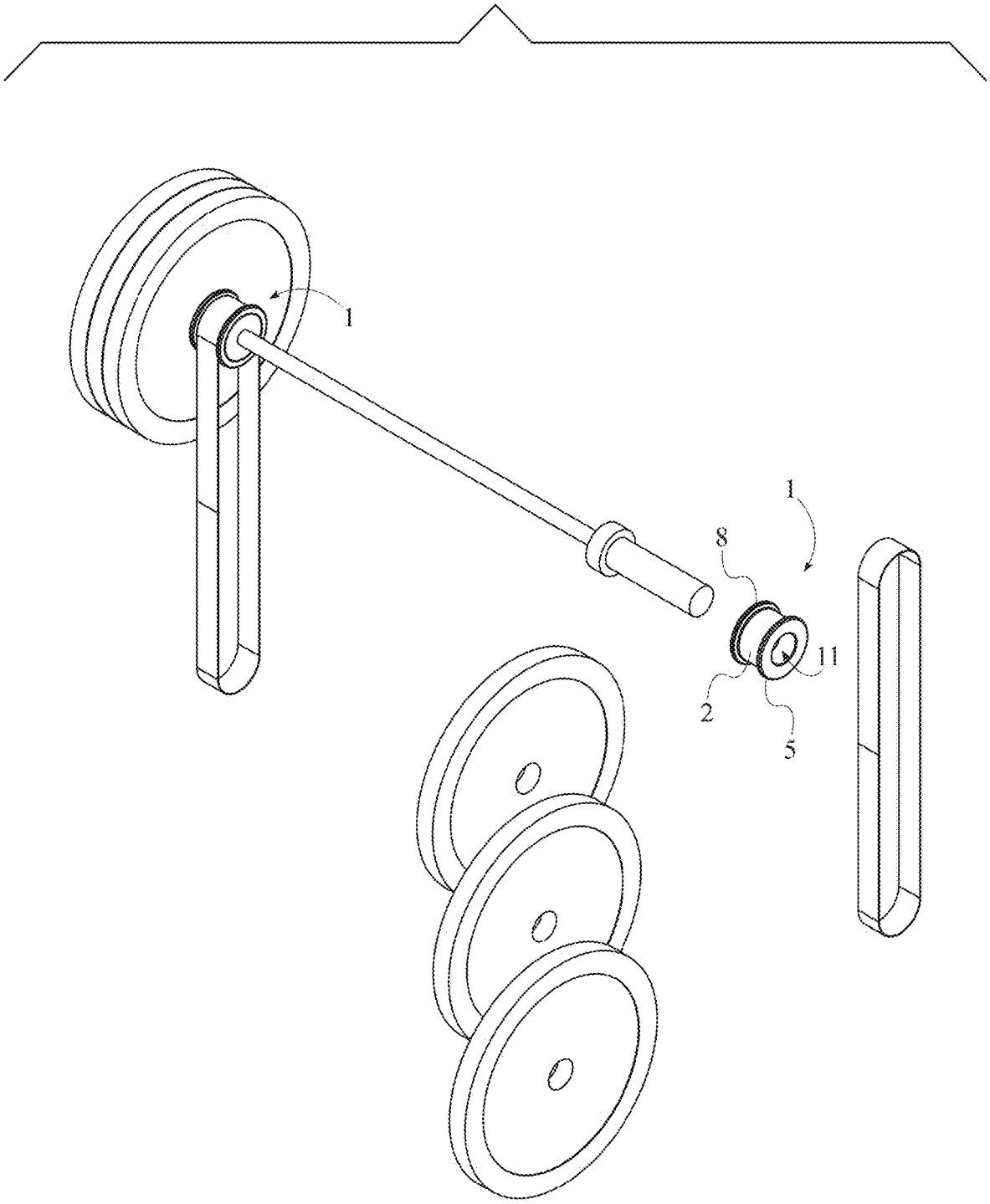
FIG. 7 is a top-front-left exploded perspective view of the present invention, wherein the present invention is shown mounted onto a barbell with weight plates.
Figure 8:
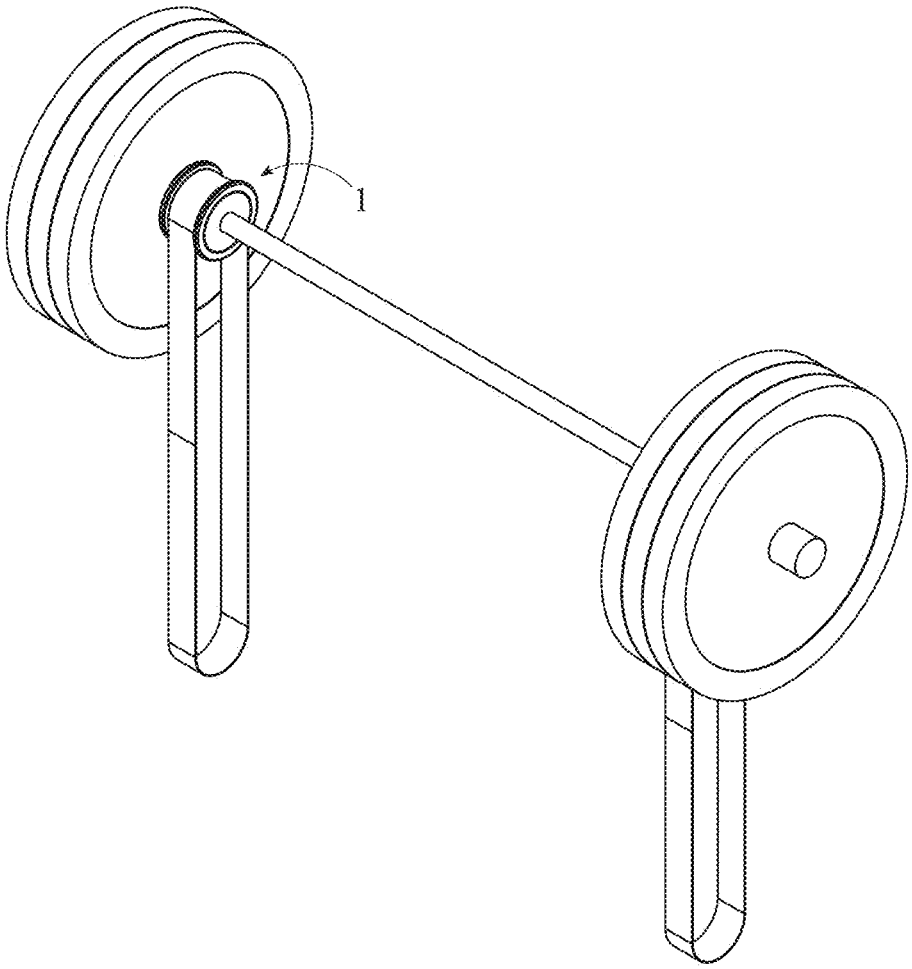
FIG. 8 is a top-front-left perspective view of the present invention thereof.
Figure 9:
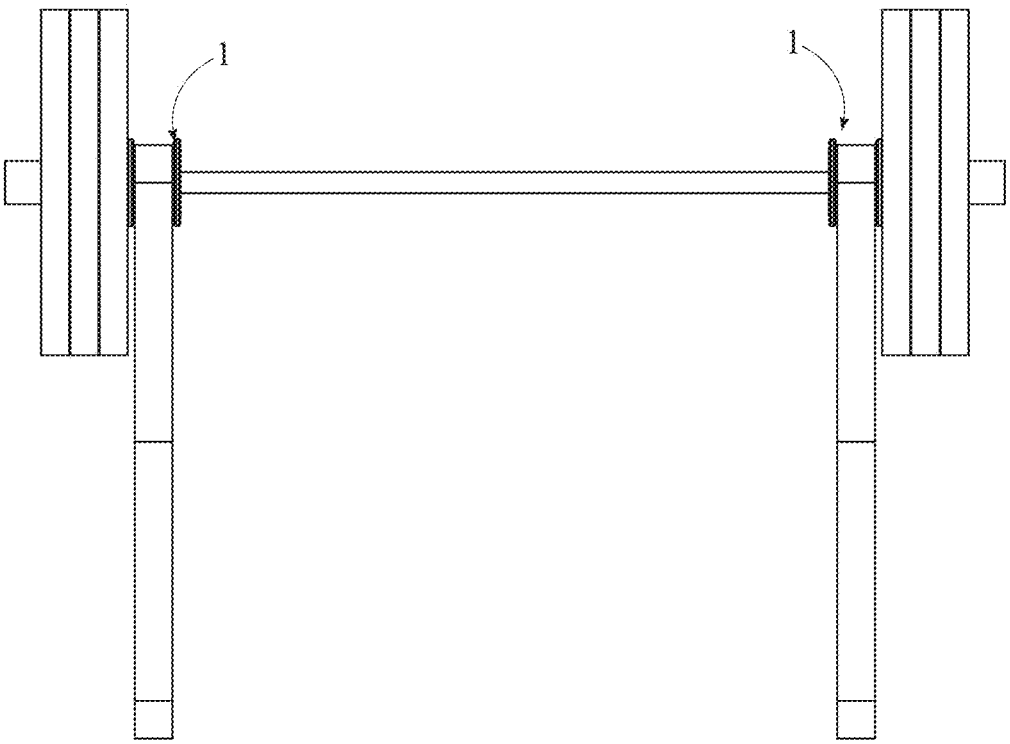
FIG. 9 is a front view of the present invention thereof.

The general configuration of the aforementioned components enables the user to safely attach resistance bands to a barbell to increase the efficiency of the exercise being performed. As can be seen in FIG. 1 through 9, the cylindrical body 1 is preferably designed to fit over the corresponding sleeve collar without obstructing the mounting of weight plates to the barbell sleeve. In general, the cylindrical body 1 comprises a lateral wall 2 a first base 3, and a second base 4. The lateral wall 2 corresponds to the cylindrical wall of the cylindrical body 1 while the first base 3 and the second base 4 correspond to the cylindrical bases of the cylindrical body 1.

In the preferred embodiment, the present invention can be arranged as follows: the lateral wall 2 the first flange 5, the second flange 8, the first adapter hole 11, and the second adapter hole 12 are axially aligned with each other to form an overall cylindrical structure, as can be seen in FIG. 1 through 6. The first base 3 and the second base 4 are also positioned opposite to each other about the cylindrical body 1 due to the overall length 16 of the cylindrical body 1. In addition, the lateral wall 2 is positioned in between the first base 3 and the second base 4 since the cylindrical body 1 is preferably designed as a solid body. Further, the first adapter hole 11 traverses through the cylindrical body 1 from the first base 3 to the second base 4 to form a through hole that allows the cylindrical body 1 to slide along the selected barbell sleeve.

On the other hand, the second adapter hole 12 traverses into the cylindrical body 1 from the second base 4 to form a bore that engages the corresponding sleeve collar, as can be seen in FIG. 1 through 6. Further, the first flange 5 is perimetrically connected around the first base 3 while the second flange 8 is perimetrically connected around the second base 4. This way, an external groove is formed on the cylindrical body 1 that accommodates the desired resistance band.

The present invention can be designed with different dimensions to accommodate barbells of different sizes. In an exemplary embodiment, the present invention can be designed to slide over a 50-millimeter (mm) barbell sleeve and the corresponding sleeve collar which is usually about one and a half inches (in.) wide and two and half to three in. in diameter. To accommodate these dimensions, the cylindrical body 1 has an outer diameter 17 of about four inches. The diameter 14 of the first adapter hole 11 is also smaller than the diameter 14 of the second adapter hole 12. For example, the first adapter hole 11 has an overall diameter 14 of two in., and the second adapter hole 12 has an overall diameter 14 of two and half to three in. In addition, the depth 15 of the second adapter hole 12 is less than half the length 16 of the lateral wall 2. For example, the length 16 of the cylindrical body 1 can be two to three in., and the second adapter hole 12 can be one to two and half in. deep depending on the manufacturer of the barbell and/or other manufacturing factors. In other embodiments, different dimensions can be implemented to accommodate barbells of different size.

Further, the depth 15 of the second adapter hole 12 should not be deeper than the width of the collar of the sleeve so that the cylindrical body 1 stops at the outer face of the sleeve collar, as can be seen in FIG. 1 through 9. For example, an Ivanko barbell has a sleeve collar that is 1.625 in. wide, so the depth 15 of the second adapter hole 12 should be about one and a half in. deep. In addition, a collar-bracing annular ledge 13 is formed within the cylindrical body 1 at an intersection of the first adapter hole 11 and the second adapter hole 12. This way, when the present invention is held in place by the barbell clamp, the collar-bracing annular ledge 13 is pressed against the outer face of the sleeve collar. In other embodiments, different clamping mechanisms can be utilized to secure the present invention to the barbell. In addition, the second adapter hole 12 can be in the shape of a hexagon to prevent rotation of the cylindrical body 1 about the corresponding sleeve collar.

In some embodiments, the outer diameter 17 of the first flange 5 is equal to the outer diameter 17 of the second flange 8. The thickness 18 of the first flange 5 is also equal to the thickness 18 of the second flange 8, as can be seen in FIG. 1 through 6. For example, the outer diameter 17 of the first flange 5 and the second flange 8 should be about four in. for a sleeve collar with a three in. diameter. This allows for a reduced diameter of the cylindrical body 1 of three and a half in. In other words, the grooved formed for the resistance band is a quarter in. deep. The outer diameter 17 and thickness 18 of the first flange 5 and the second flange 8 limit how deep the groove can be. For example, a four in. cylindrical body 1 with a three in. second adapter hole 12 allows for a groove of a little over 0.25 in. Most resistance bands used for this purpose are 0.25 in. or less. This ensures that the groove is deeper than the thickness of the attached resistance band. In other embodiments, the first flange 5 and the second flange 8 can have different outer diameters and/or thicknesses.

In the preferred embodiment, the inner surfaces of the first flange 5 and the second flange 8 are not parallel to facilitate the centering of the resistance band on the cylindrical body 1. As can be seen in FIG. 1 through 6, the first flange 5 comprises a first outer annular surface 6 and a first inner annular surface 7 corresponding to the two opposite annular surfaces of the first flange 5. The first outer annular surface 6 coincides with the first base 3, while the first inner annular surface 7 is positioned offset to the first outer surface. This way, the first flange 5 is positioned around the perimeter of the first base 3. Further, the first inner annular surface 7 is oriented at a first acute angle 19 with the first outer annular surface 6 to guide the attached resistance band towards the center of the cylindrical body 1.

Likewise, the second flange 8 comprises a second outer annular surface 9 and a second inner annular surface 10 corresponding to the two opposite annular surfaces of the second flange 8, as can be seen in FIG. 1 through 6. The second outer annular surface 9 coincides with the second base 4, while the second inner annular surface 10 is positioned offset to the second outer surface. This way, the second flange 8 is positioned around the perimeter of the second base 4. Further, the second inner annular surface 10 is oriented at a second acute angle 20 with the second outer annular surface 9 to guide the attached resistance band towards the center of the cylindrical body 1.

In some embodiments, the first acute angle 19 and the second acute angle 20 are equal, each being approximately in the range of 10 to 30 degrees. However, the first flange 5 and the second flange 8 do not have to be symmetrical, as can be seen in FIG. 1 through 6. For example, the second flange 8 may have a 30-degree angle because the second flange 8 is positioned on the side that is most used for an anchor point. On the other hand, the first flange 5 may have a 10-degree angle. Further, the inner outer edges of the first flange 5 and the second flange 8 can be rounded to help guide the attached resistance band into the formed groove as well as to prevent damage or cause wear during the movement of the barbell. The rounded inner outer edges of the first flange 5 and the second flange 8 can have a radius of 0.030 to 0.125 in. depending on the width of the cylindrical body 1. A wider cylindrical body 1 allows for a wider groove with steeper inner annular surfaces and inner outer edges with larger radii. In other embodiments, different protective features can be implemented to prevent damage to the attached resistance band.

In general, the material used in the manufacture of the present invention can be metal or plastic, which would also influence the depth of the formed groove, as can be seen in FIG. 1 through 6. Further, different external features can be implemented that increase the overall functionality of the present invention. For example, the combined exterior surface of the cylindrical body 1, the first flange 5, and the second flange 8 can be inscribed with a specific color which can be used to color-code the present invention. Specific colors can be used to indicate which barbell the present invention can be used with. This is useful when barbells of different sizes are available, and the user needs to determine which sizes of the present invention are necessary. In other embodiments, additional features can be utilized to help the user identify the correct unit of the present invention that needs to be used with a desired barbell.

Although the invention has been explained in relation to its preferred embodiment, it is to be understood that many other possible modifications and variations can be made without departing from the spirit and scope of the invention.

What is claimed is:

1. A resistance band adapter for a barbell comprising:
a cylindrical body;
a first flange;
a second flange;
a first adapter hole;
a second adapter hole;
the cylindrical body comprising a lateral wall, a first base, and a second base;
the lateral wall, the first flange, the second flange, the first adapter hole, and the second adapter hole being axially aligned with each other;
the first base and the second base being positioned opposite to each other about the cylindrical body;
the lateral wall being positioned in between the first base and the second base;
the first adapter hole traversing through the cylindrical body from the first base to the second base;
the second adapter hole traversing into the cylindrical body from the second base;
the first flange being perimetrically connected around the first base;
the second flange being perimetrically connected around the second base;
wherein a diameter of the first adapter hole is smaller than a diameter of the second adapter hole; and
wherein a depth of the second adapter hole is less than half a length of the lateral wall.

2. The resistance band adapter for a barbell as claimed in claim 1 comprising:
a collar-bracing annular ledge;
the collar-bracing annular ledge being positioned within the cylindrical body; and
the collar-bracing annular ledge being positioned at an intersection of the first adapter hole and the second adapter hole.

3. The resistance band adapter for a barbell as claimed in claim 1, wherein an outer diameter of the first flange is equal to an outer diameter of the second flange.

4. The resistance band adapter for a barbell as claimed in claim 1, wherein a thickness of the first flange is equal to a thickness of the second flange.

5. The resistance band adapter for a barbell as claimed in claim 1 further comprising:
the first flange comprising a first outer annular surface and a first inner annular surface;
the first outer annular surface being coincident with the first base;
the first inner annular surface being positioned offset to the first outer surface; and
the first inner annular surface being oriented at a first acute angle with the first outer annular surface.

6. The resistance band adapter for a barbell as claimed in claim 1 further comprising:
the second flange comprising a second outer annular surface and a second inner annular surface;
the second outer annular surface being coincident with the second base;
the second inner annular surface being positioned offset to the second outer surface; and
the second inner annular surface being oriented at a second acute angle with the second outer annular surface.

7. The resistance band adapter for a barbell as claimed in claim 1, wherein a combined exterior surface of the cylindrical body, the first flange, and the second flange is inscribed with a specific color.

8. The resistance band adapter for a barbell as claimed in claim 1, wherein the second adapter hole is a cylindrical hole.

9. The resistance band adapter for a barbell as claimed in claim 1, wherein the second adapter hole is a hexagonal hole.

10. A resistance band adapter for a barbell comprising:
a cylindrical body;
a first flange;
a second flange;
a first adapter hole;
a second adapter hole;
a collar-bracing annular ledge;
the cylindrical body comprising a lateral wall, a first base, and a second base;
the lateral wall, the first flange, the second flange, the first adapter hole, and the second adapter hole being axially aligned with each other;
the first base and the second base being positioned opposite to each other about the cylindrical body;
the lateral wall being positioned in between the first base and the second base;
the first adapter hole traversing through the cylindrical body from the first base to the second base;
the second adapter hole traversing into the cylindrical body from the second base;
the first flange being perimetrically connected around the first base;
the second flange being perimetrically connected around the second base; the collar-bracing annular ledge being positioned within the cylindrical body;
and the collar-bracing annular ledge being positioned at an intersection of the first adapter hole and the second adapter hole; and
wherein a diameter of the first adapter hole is smaller than a diameter of the second adapter hole, and wherein a depth of the second adapter hole is less than half a length of the lateral wall.

11. The resistance band adapter for a barbell as claimed in claim 10, wherein an outer diameter of the first flange is equal to an outer diameter of the second flange, and wherein a thickness of the first flange is equal to a thickness of the second flange.

12. The resistance band adapter for a barbell as claimed in claim 10 further comprising:
the first flange comprising a first outer annular surface and a first inner annular surface;
the first outer annular surface being coincident with the first base;
the first inner annular surface being positioned offset to the first outer surface; and
the first inner annular surface being oriented at a first acute angle with the first outer annular surface.

13. The resistance band adapter for a barbell as claimed in claim 10 further comprising:
the second flange comprising a second outer annular surface and a second inner annular surface;
the second outer annular surface being coincident with the second base;

the second inner annular surface being positioned offset to the second outer surface; and the second inner annular surface being oriented at a second acute angle with the second outer annular surface.

14. The resistance band adapter for a barbell as claimed in claim 10, wherein a combined exterior surface of the cylindrical body, the first flange, and the second flange is inscribed with a specific color.

15. The resistance band adapter for a barbell as claimed in claim 10, wherein the second adapter hole is a cylindrical hole.

16. The resistance band adapter for a barbell as claimed in claim 10, wherein the second adapter hole is a hexagonal hole.

* * * * *